US005410632A

United States Patent [19]

Hong et al.

[11] Patent Number: 5,410,632

[45] Date of Patent: Apr. 25, 1995

[54] VARIABLE HANGOVER TIME IN A VOICE ACTIVITY DETECTOR

[75] Inventors: Daehyoung Hong, Hanover Park; Douglas A. Carlone, Naperville, both of Ill.

[73] Assignee: Motorola, Inc., Schaumburg, Ill.

[21] Appl. No.: 812,299

[22] Filed: Dec. 23, 1991

[51] Int. Cl.[6] ..... G10L 3/00

[52] U.S. Cl. ..... 395/2.42; 381/47; 381/46; 381/40

[58] Field of Search ..... 381/30–31, 381/35–37, 46≧47, 110, 43

[56] References Cited

U.S. PATENT DOCUMENTS

| | | | |
|---|---|---|---|
| 4,028,496 | 6/1977 | La Marche et al. | 381/46 |
| 4,167,653 | 9/1979 | Araseki et al. | 381/46 |
| 4,357,491 | 11/1982 | Daaboul et al. | 381/46 |
| 4,630,304 | 12/1986 | Borth et al. . | |
| 4,630,305 | 12/1986 | Borth et al. . | |
| 4,672,669 | 6/1987 | Des Blache et al. | 381/46 |
| 4,700,392 | 10/1987 | Kato et al. | 381/46 |
| 4,811,404 | 3/1989 | Vilmur et al. | 381/47 |
| 4,817,157 | 3/1989 | Gerson . | |
| 4,980,916 | 12/1990 | Zinser | 381/47 |

FOREIGN PATENT DOCUMENTS

0194785A2 2/1986 European Pat. Off. .

OTHER PUBLICATIONS

Y. Yatsuzuka, "Highly Sensitive Speech Detector and High-Speed Voiceband Data Discriminator in DSI--ADPCM Systems," IEEE Transactions on Communications, vol. COM-30, No. 4, pp. 739-750, Apr. 1982.

R. Easton et al., "TASI-E Communications System," IEEE Transactions on Communications, vol. COM-30, No. 4, pp. 803-807, Apr. 1982.

C. Southcott et al., "Voice Control of the Pan--European Digital Mobile Radio System," Proc. IEEE Globecom '89, pp. 1070-1074, Dec. 1989.

*Primary Examiner*—Mark R. Powell
*Assistant Examiner*—Kee M. Tung
*Attorney, Agent, or Firm*—Susan L. Lukasik; Steven G. Parmelee

[57] ABSTRACT

Variable hangover time is provided for a speech coder (105). Voice activity within a speech message is detected (209) using a voice activity detector (VAD) (107), and a signal-to-noise ratio is calculated. A variable hangover time is calculated (215) and appended to the time in which voice activity is detected, producing an extended voice detection period. The speech coder (105) is enabled only during the extended voice detection period, thus saving power.

10 Claims, 2 Drawing Sheets

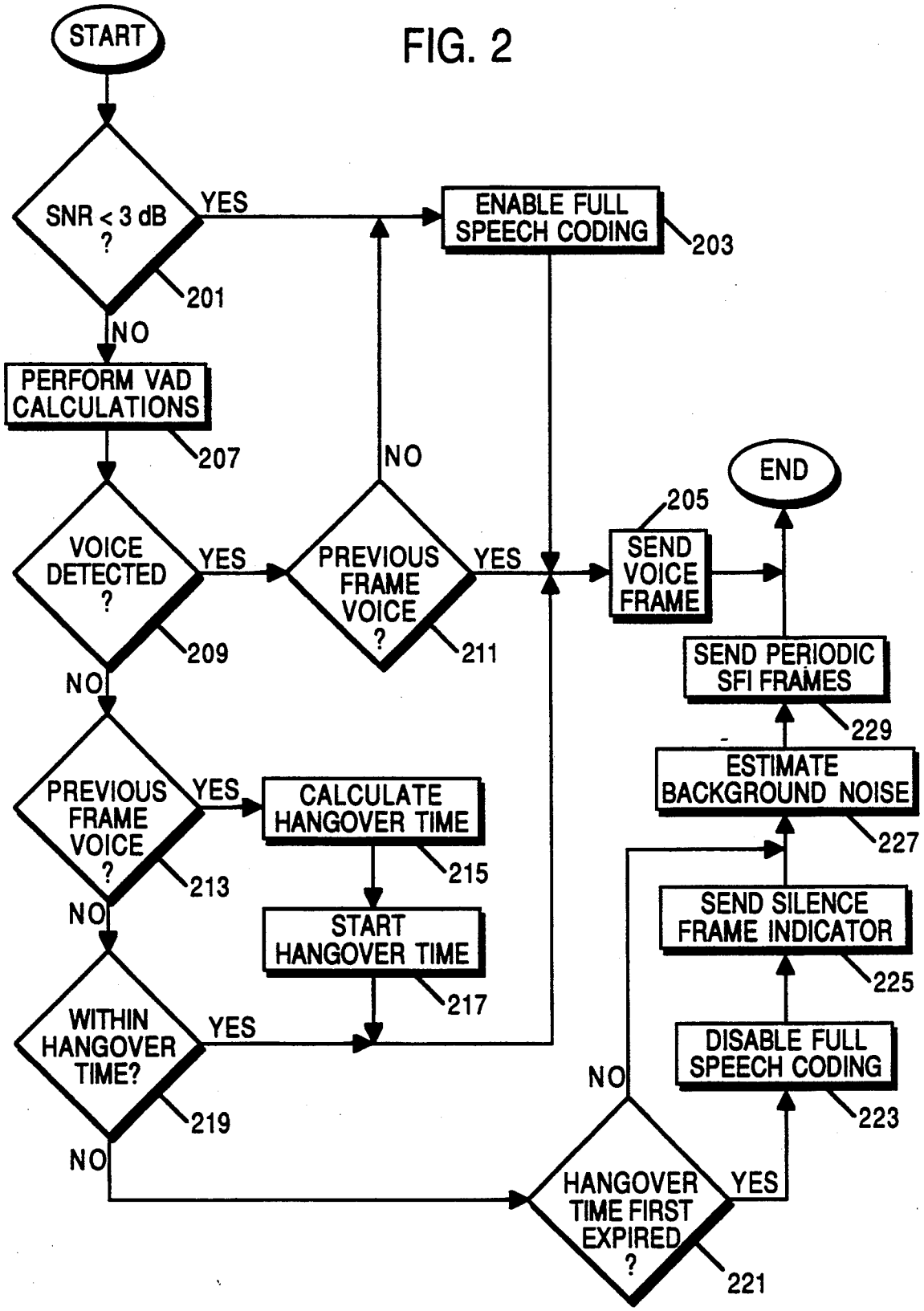
FIG. 2
START
SNR < 3 dB ?
YES
NO
201
ENABLE FULL SPEECH CODING
203
PERFORM VAD CALCULATIONS
207
VOICE DETECTED ?
YES
NO
209
PREVIOUS FRAME VOICE ?
YES
NO
211
SEND VOICE FRAME
205
END
PREVIOUS FRAME VOICE ?
YES
NO
213
CALCULATE HANGOVER TIME
215
START HANGOVER TIME
217
WITHIN HANGOVER TIME?
YES
NO
219
HANGOVER TIME FIRST EXPIRED ?
YES
NO
221
DISABLE FULL SPEECH CODING
223
SEND SILENCE FRAME INDICATOR
225
ESTIMATE BACKGROUND NOISE
227
SEND PERIODIC SFI FRAMES
229

VARIABLE HANGOVER TIME IN A VOICE ACTIVITY DETECTOR

FIELD OF THE INVENTION

This invention relates to voice activity detectors, including but not limited to hangover time in voice activity detectors for speech coders.

BACKGROUND OF THE INVENTION

Many speech coders today use a voice activity detector (VAD) to detect the presence of speech amid various types of background noise. Detection of voice activity assists communications in many ways. While there is no speech present, no information is transmitted, thus less information occupies the communication channel. Transmitting less information results in a savings in battery charge. Because many speech coders are implemented in a Digital Signal Processor (DSP), the speech coder can consume a lot of current while in full operation. If the VAD could be modified to turn off the speech coder while no speech is detected, this would save current that may be crucial to a portable communication unit which derives all of its power from a battery. The VAD may also be modified to turn off other communication unit functions that are not needed when there is no speech to transmit, resulting in additional battery savings.

A processing error associated with VADs is clipping at the tail (end) of a speech burst. Clipping of speech bursts degrades the speech quality and intelligibility and is easily noticed. Such clipping is prevalent when the final sound of a word is soft and blends in with the noise in the background. To fix this problem, a fixed time period, called a hangover time, has been used to keep the transmitter on after the VAD no longer detects speech activity. Using a fixed time period has its drawbacks. In periods of high signal-to-noise ratio, a fixed hangover time is too long, and wastes the communication channel. When the signal-to-noise ratio is low, the fixed hangover time can be too short, causing the communication to be clipped, resulting in a choppy-sounding communication.

Listening to a pattern of speech bursts separated by completely soundless gaps is difficult to listen to. Note that "silence" refers to the absence of speech or voice rather than total absence of sound. The VAD measures the background noise at the transmitter immediately after a speech burst. A background noise characteristic, such as the energy of the background noise, is measured and transmitted with the speech bursts to the receiver. The receiver uses this background noise characteristic to reproduce the background noise. This reproduced noise is used to fill in the gaps between speech bursts, and the listener hears a more pleasing sound at the speaker. If this measurement is taken over a very short interval, it will be susceptible to bad reproduction due to quick changes in the background noise.

Accordingly, a VAD which turns a speech coder on and off, incorporates a variable hangover time, and uses an improved background noise measurement convention is desired.

BRIEF DESCRIPTION OF THE DRAWINGS

FIG. 2 is a flowchart showing incorporation of variable hangover time in a communication unit in accordance with the invention.

DESCRIPTION OF A PREFERRED EMBODIMENT

The following describes a VAD with a variable hangover time. A threshold calculation combined with a hangover time calculation allow dynamic variability of the hangover time for the VAD. While speech is not detected after the hangover period, background noise measurements are averaged over this entire time interval.

Figure 1:
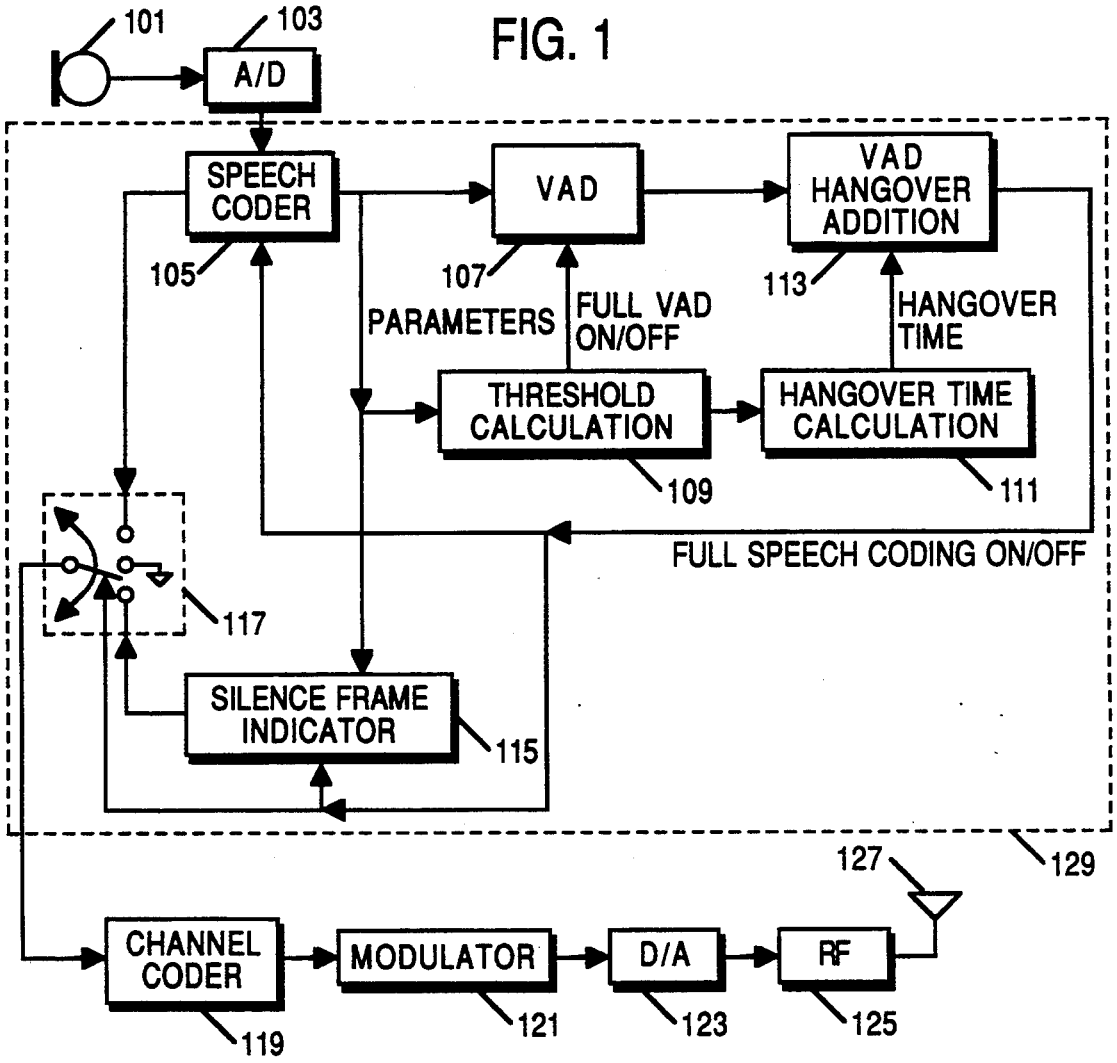
FIG. 1 is a block diagram of a communication unit with variable hangover time in accordance with the invention.

A block diagram of a communication unit with variable hangover time is shown in FIG. 1. A speech message, including speech (voice) and background noise, enters a microphone 101 and is converted to digital data in an A/D (Analog to Digital) convertor 103. The output of the Aft) converter enters a speech coder 105. The speech coder is programmed as desired to effectuate a particular voice coding methodology, such as CELP (code-excited linear prediction) or VSELP (vector sum excited linear prediction). In this particular embodiment, it will be presumed that the coding methodology of choice is VSELP, as disclosed in U.S. Pat. No. 4,817,157 entitled "Digital Speech Coder Having Improved Vector Excitation Source," which is incorporated herein by reference.

The speech coder 105 calculates one or more parameters, such as covariance values, including short term LPC (linear predictive coding) values as are known in the art, or long-term predictors, as described in the above U.S. Pat. No. 4,817,157. While the speech coder 105 is turned on, it calculates these parameters at all times. When the speech coder is on and full speech coding is enabled by the FULL SPEECH CODING (FSC) ON/OFF signal, the speech coder 105 codes speech, and coded speech is output to switch 117. The parameters are sent to a VAD 107 (which performs conventional voice activity detection functions as well as other functions defined herein), a threshold calculation block 109, and a silence frame indicator (SFI) block 115. The parameters contain information to enable detection of voice activity, background noise measurement, and signal-to-noise ratio (SNR) calculations, as are known in the art. The VAD 107 uses the parameters to detect voice activity and generates a signal showing whether or not voice has been detected.

In the preferred embodiment, the VAD 107 expects the parameters to be autocorrelation values, as are known in the art, as shown in Equation 1, where L is the frame length in digital samples, s(k) is the input signal, and M is the number of LPC coefficients, as is known in the art. Note that the value of R(n) is not dependent on the starting point k.

$$R(n) = \sum_{i=0}^{L-1-n} s(k+i)\,s(k+n+i) \quad \text{for } 0 \leqq n \leqq M \qquad \text{Equation 1}$$

A VSELP speech coder 105 outputs covariance values as shown in Equation 2. Note that the value of $\phi$ (k,n) is dependent on the starting point k.

$$\phi(k,n) = \sum_{i=0}^{L-l-n} s(k+i)\,s(k+n+i) \quad \text{for } 0 \leqq n \leqq M \qquad \text{Equation 2}$$

In the preferred embodiment, the VAD 107 modifies the covariance values by estimating them as autocorrelation values as shown in Equation 3.

$$\hat{R}(n) = \frac{1}{M-n+1} \sum_{k=0}^{M-n} \phi(k,n) \qquad \text{Equation 3}$$

The threshold calculation block 109 calculates a SNR based on the parameter or parameters it receives. When the SNR calculated in threshold calculation block 109 is less than 3 dB, most functions in the VAD 107 are turned off using the FULL VAD ON/OFF signal output by the threshold calculation block 109. When the FULL VAD ON/OFF signal is low, i.e., off, the VAD 107 output signal remains a logical "high," and consequently a VAD hangover addition block 113 enables full speech coding via the FSC ON/OFF signal to the speech coder 105. This has the effect of an indefinite hangover time, since at this SNR, it is very difficult for the VAD to detect speech from noise accurately. Power is saved by deactivating the majority of the VAD 107 during this time. The accuracy of the detection of voice activity is questionable at low SNRs, and the VAD 107 is turned off to prevent voice quality degradation. When the SNR calculated in threshold calculation block 109 is greater than or equal to 3 dB, the VAD 107 is turned completely on using the FULL VAD ON/OFF signal output by the threshold calculation block 109.

The hangover time (HT) for VAD 107 is calculated in a hangover time calculation block 111 using the SNR calculation from the threshold calculation block 109. In the preferred embodiment, the hangover time calculation to calculate HT is performed according to Table 1. For example, if SNR is 14 dB, HT=150 ms which is equivalent to five 30 ms VSELP speech frames. If SNR is 2 dB, the function of the VAD 107 is minimized as described above, and full speech coding is enabled in the speech coder 105. Table 2 shows alternative hangover times based on higher resolution between SNR levels and hangover times. The resolution can be made even higher, with smaller and smaller SNR levels until a linear and/or logarithmic equation is a better depiction of the calculation than a table. However, as the difference between hangover time intervals becomes shorter, its effect on the sound heard becomes negligible, and the calculation becomes more complex, taking up more time and energy than such an endeavor is worth.

TABLE 1

| Hangover Time | |
|---|---|
| 23 dB ≦ SNR | HT = 90 ms = 3 speech frames |
| 20 dB ≦ SNR < 23 dB | HT = 120 ms = 4 speech frames |
| 13 dB ≦ SNR < 20 dB | HT = 150 ms = 5 speech frames |
| 10 dB ≦ SNR < 13 dB | HT = 180 ms = 6 speech frames |
| 3 dB ≦ SNR < 10 dB | HT = 210 ms = 7 speech frames |
| SNR < 3 dB | VAD functions minimized |

TABLE 2

| Alterative Hangover Times | |
|---|---|
| 23 dB ≦ SNR | HT = 90 ms = 3 speech frames |

TABLE 2-continued

| Alterative Hangover Times | |
|---|---|
| 22 dB ≦ SNR < 23 dB | HT = 100 ms |
| 21 dB ≦ SNR < 22 dB | HT = 110 ms |
| 20 dB ≦ SNR < 21 dB | HT = 120 ms = 4 speech frames |
| 18 dB ≦ SNR < 20 dB | HT = 130 ms |
| 15 dB ≦ SNR < 18 dB | HT = 140 ms |
| 13 dB ≦ SNR < 15 dB | HT = 150 ms = 5 speech frames |
| 12 dB ≦ SNR < 13 dB | HT = 160 ms |
| 11 dB ≦ SNR < 12 dB | HT = 170 ms |
| 10 dB ≦ SNR < 11 dB | HT = 180 ms = 6 speech frames |
| 8 dB ≦ SNR < 10 dB | HT = 190 ms |
| 5 dB ≦ SNR < 8 dB | HT = 200 ms |
| 3 dB ≦ SNR < 5 dB | HT = 210 ms = 7 speech frames |
| SNR < 3 dB | VAD functions minimized |

The VAD hangover addition block 113 inputs the value of HT from the hangover time calculation block 111 and the VAD 107 output signal, which is a logical "high" when voice activity is detected (during the period of detected voice) and a logical "low" when voice activity is not detected. The output, the FSC ON/OFF signal, of the VAD hangover addition block 113 is generally the same as the VAD 107 output signal, except when the block 113 detects a low-going edge of the VAD 107 output signal. When this edge is detected, the FSC ON/OFF signal is kept high for an additional time equal to the time value of HT. Thus, the VAD hangover addition block produces an extended voice detection period by appending the hangover time to the period of detected voice. See FIG. 3 and associated text for an example.

The SFI block 115 receives the same parameters as the VAD 107 and the threshold calculation block 109. The SFI block 115 uses these parameters to estimate the background noise. The SFI block 115 also receives the FSC ON/OFF signal. When this signal first becomes a logical "low," the SFI block 115 outputs an SFI frame consisting of the background noise estimate and a special code to indicate that this is not voice data. While the FSC ON/OFF signal remains low, the SFI block 115 periodically outputs SFI frames so that the reproduced background noise at the receiver follows changes in the actual background noise. The SFI frames are sent to the channel coder 119 via switch 117. The FSC ON/OFF signal controls which data the switch sends to the channel coder 119. When this signal is a logical "high," coded speech passes through to the channel coder 119 from the speech coder 105. When this signal first becomes a logical "low," the SFI block 115 output is coupled to the channel coder 119. After the SFI frame is sent from SFI block 115, and if the FSC ON/OFF signal is still a logical "low," switch 117 connects the channel coder 119 to ground (i.e., no data is transmitted). As long as the FSC ON/OFF signal remains a logical "low," the channel coder 119 is connected to ground except for the periodic transmission of an SFI update frame from SFI block 115 as previously described. The output of the channel coder 119 is coupled to a modulator 121 which modulates the information only while the channel coder 119 is not grounded. Digital-to-analog conversion is performed on the modulator 121 output in a D/A convertor 123. The analog output enters the RF section 125 for transmission through an antenna 127.

The functions in block 129 are performed in a DSP, such as a DSP56000 available from Motorola, Inc. By turning off the sections of the VAD 107 and speech coder 105 when they are not needed, a substantial power savings can be achieved. In the DSP, this is equivalent to not performing certain algorithms or parts of algorithms, which saves energy because each instruction performed in a DSP uses energy.

A flowchart showing incorporation of variable hangover time in a communication unit is shown in FIG. 2. The steps in this flowchart reflect activities performed in blocks 107, 109, 111, 113, 115, and 117. The flowchart is entered each time a new speech frame begins within a speech message. If at step 201, SNR is less than 3 dB, as calculated by threshold calculation block 109, full speech coding is enabled, as previously described, at step 203. The current voice frame is sent at step 205, and the process ends.

If at step 201, SNR is not less than 3 dB, as calculated by threshold calculation block 109, the VAD 107 performs its conventional calculations and functions at step 207. If voice is detected by the VAD 107 at step 209, and the previous frame was detected as a voice frame at step 211, the process continues with step 205. If voice is detected by the VAD 107 at step 209, and the previous frame was not a voice frame at step 211, signifying the end of a silence period, the process continues with step 203.

If voice is not detected by the VAD 107 at step 209, and the previous frame was detected as a voice frame at step 213, the hangover time is calculated at step 215 by the hangover time calculation block 111, as previously described. The hangover time is started at step 217 by the VAD hangover addition block 113, and the process continues with step 205. If the previous frame was not detected as a voice frame at step 213, and the current frame is within the hangover time at step 219, the process continues with step 205.

If the current frame is not within the hangover time at step 219, and the current frame is the first frame in which the hangover time has expired at step 221, full speech coding is disabled at step 223, the silence frame indicator (SFI) is sent at step 225, and the process continues with step 227.

If the current frame is not the first frame in which the hangover time has expired at step 221, the background noise is estimated, as is known in the art, by the SFI block 115 for the current frame at step 227. In the preferred embodiment, a running average of the background noise estimate is computed. Thus, an averaged background noise estimate is a running average of the background noise estimates of all previous silence frames, resulting in a more accurate measure of the background noise than simply using an estimate of only one silence period. At step 229, an SFI frame is periodically transmitted, and the process ends.

Figure 3:
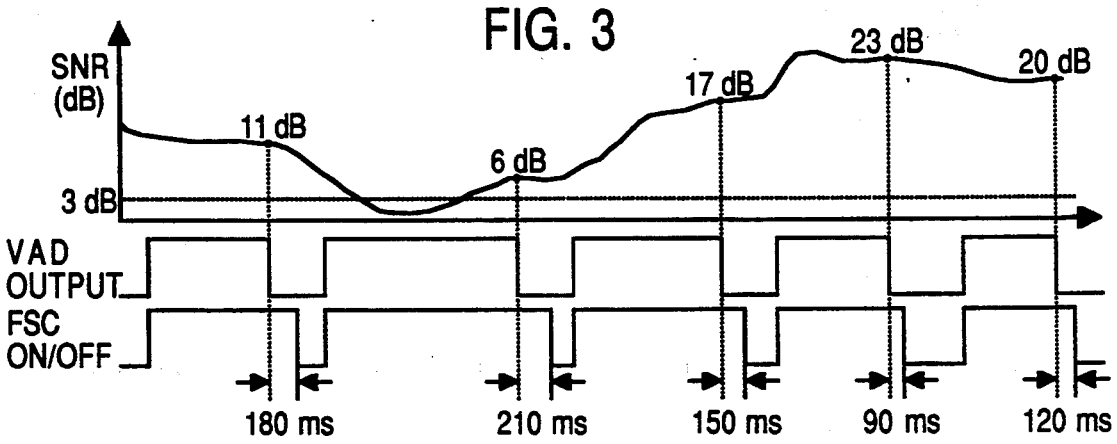
FIG. 3 is a diagram showing addition of variable hangover time to a VAD signal in accordance with the invention.

A diagram showing addition of variable hangover time to a VAD signal is shown in FIG. 3. An analog representation of an example SNR pattern for a possible time interval, an example VAD 107 output signal, and the resulting FSC ON/OFF signal are shown versus a time axis. At the end of the first period of detected voice, the SNR was measured at 11 dB, resulting in a 180 ms (6 speech frames) hangover time. Thus, the FSC ON/OFF signal shows the first extended voice detection period that incorporates the first period of detected voice with the hangover time appended. The first extended voice detection period was immediately followed by a first silence period.

During the first silence period and shortly after the hangover time expired, speech was again detected by the VAD 107. During this period, the SNR fell below 3 dB, during which time the VAD output signal remained a logical "high." When the SNR rose to 3 dB, voice was detected, and the VAD output signal remained a logical "high." At the end of the second period of detected voice, the SNR was measured at 6 dB, resulting in a 210 ms (7 speech frames) hangover time. Shortly after the second hangover time expired, speech was again detected by the VAD 107. At the end of the third period of detected voice, the SNR was measured at 17 dB, resulting in a 150 ms (5 speech frames) hangover time. Shortly after the third hangover time expired, speech was again detected by the VAD 107. At the end of the fourth period of detected voice, the SNR was measured at 23 dB, resulting in a 90 ms (3 speech frames) hangover time. Shortly after the fourth hangover time expired, speech was again detected by the VAD 107. At the end of the fifth period of detected voice, the SNR was measured at 20 dB, resulting in a 120 ms (4 speech frames) hangover time. As seen in FIG. 3, consecutive voice periods are separated by silence periods.

Variable hangover times provide a shorter hangover time in higher SNR conditions. When compared to a fixed hangover time, which is longer to compensate for low SNR conditions, a shorter hangover time saves time on the channel as well as power required to transmit a longer signal because nothing is transmitted during a silence period except the periodic SFI frames. Variable hangover times provide a longer hangover time in lower SNR conditions. Longer hangover times in low SNR conditions, when the VAD is not as accurate in detecting speech, help prevent clipping at the end of a speech segment occurring due to a fixed hangover time.

What is claimed is:

1. An apparatus for enabling a speech coder to provide a variable hangover time, the apparatus comprising:

means for detecting voice activity in a speech message;

means, coupled to said means for detecting, for generating a signal showing a period of detected voice;

means for calculating a signal-to-noise ratio on said speech message;

means, coupled to said means for calculating a signal-to-noise ratio, for calculating a variable hangover time;

means, coupled to said means for calculating said variable hangover time, for appending said variable hangover time to said period of detected voice, thereby producing an extended voice detection period;

means for enabling the speech coder during said extended voice detection period; and means for turning off said means for detecting voice activity when said signal-to-noise ratio falls beyond a predetermined threshold.

2. The apparatus of claim 1, wherein said speech coder effectuates vector sum excited linear prediction as its coding methodology.

3. An apparatus for enabling a speech coder to provide a variable hangover time, the apparatus comprising:

means for detecting voice activity in a speech message;

means, coupled to said means for detecting, for generating a signal showing a period of detected voice;

means for calculating a signal-to-noise ratio on said speech message;

means, coupled to said means for calculating a signal-to-noise ratio, for calculating a variable hangover time;

means, coupled to said means for calculating said variable hangover time, for appending said variable hangover time to said period of detected voice, thereby producing an extended voice detection period;

means for enabling the speech coder during said extended voice detection period;

means for sending part of said speech message during a first extended voice detection period and a second extended voice detection period, wherein said first and second extended voice detection periods are consecutive;

means for estimating background noise in a silence period between said first extended voice detection period and said second extended voice detection period;

means, coupled to said means for estimating, for averaging said background noise estimates in said silence period with background noise estimates from previous silence periods; and means, coupled to said means for averaging, for sending said averaged background noise estimates periodically during said silence period.

4. A method of enabling a speech coder to provide a variable hangover time, comprising steps of:

detecting voice activity in a speech message;

generating, responsive to said step of detecting, a signal showing a period of detected voice;

calculating a signal-to-noise ratio on said speech message;

calculating, responsive to said step of calculating a signal-to-noise ratio, a variable hangover time;

appending, responsive to said step of calculating said variable hangover time, said variable hangover time to said period of detected voice, thereby producing an extended voice detection period;

enabling the speech coder during said extended voice detection period; and ceasing detecting voice activity when said signal-to-noise ratio falls beyond a predetermined threshold.

5. The method of claim 4, wherein the speech coder effectuates vector sum excited linear prediction as its coding methodology.

6. A method of enabling a speech coder to provide a variable hangover time, comprising steps of:

detecting voice activity in a speech message;

generating, responsive to said step of detecting, a signal showing a period of detected voice;

calculating a signal-to-noise ratio on said speech message;

calculating, responsive to said step of calculating a signal-to-noise ratio, a variable hangover time;

appending responsive to said step of calculating said variable hangover time, said variable hangover time to said period of detected voice, thereby producing an extended voice detection period;

enabling the speech coder during said extended voice detection period;

sending part of said speech message during a first extended voice detection period and a second extended voice detection period, wherein said first and second extended voice detection periods are consecutive;

estimating background noise in a silence period between said first extended voice detection period and said second extended voice detection period;

averaging, responsive to said step of estimating, said background noise estimates in said silence period with background noise estimates from previous silence periods; and sending, responsive to said step of averaging, said averaged background noise estimates periodically during said silence period.

7. A communication unit, comprising:

a speech coder for coding a speech message;

means for detecting voice activity in said speech message;

means, coupled to said means for detecting, for generating a signal showing a period of detected voice;

means for calculating a signal-to-noise ratio on said speech message;

means, coupled to said means for calculating a signal-to-noise ratio, for calculating a variable hangover time;

means, coupled to said means for calculating said variable hangover time, for appending said variable hangover time to said period of detected voice, thereby producing an extended voice detection period;

means for enabling said speech coder during said extended voice detection period;

means for transmitting said coded speech message only while said speech coder is enabled; and means for turning off said means for detecting voice activity when said signal-to-noise ratio falls beyond a predetermined threshold.

8. The communication unit of claim 7, wherein said speech coder effectuates vector sum excited linear prediction as its coding methodology.

9. A communication unit, comprising:

a speech coder for coding a speech message;

means for detecting voice activity in said speech message;

means, coupled to said means for detecting, for generating a signal showing a period of detected voice;

means for calculating a signal-to-noise ratio on said speech message;

means, coupled to said means for calculating a signal-to-noise ratio, for calculating a variable hangover time;

means, coupled to said means for calculating said variable hangover time, for appending said variable hangover time to said period of detected voice, thereby producing an extended voice detection period;

means for enabling said speech coder during said extended voice detection period;

means for transmitting said coded speech message only while said speech coder is enabled;

means for sending said coded speech message during a first extended voice detection period and a second extended voice detection period, wherein said first and second extended voice detection periods are consecutive;

means for estimating background noise in a silence period between said first extended voice detection period and said second extended voice detection period;

means, coupled to said means for estimating, for averaging said background noise estimates in said silence period with background noise estimates from previous silence periods; and means, coupled to said means for averaging, for sending said averaged background noise estimates periodically during said silence period.

10. An apparatus for enabling a speech coder, comprising:

means for detecting voice activity in a speech message;

means, coupled to said means for detecting, for generating a signal showing a period of detected voice;

means, operatively coupled to said means for detecting, for calculating a variable hangover time;

means, coupled to said means for calculating said variable hangover time, for appending said variable hangover time to said period of detected voice, thereby producing an extended voice detection period;

means for sending part of said speech message during a first extended voice detection period and a second extended voice detection period, wherein said first and second extended voice detection periods are consecutive;

means for estimating background noise in a silence period between said first extended voice detection period and said second extended voice detection period;

means, coupled to said means for estimating, for averaging said background noise estimates in said silence period with background noise estimates from previous silence periods;

means, coupled to said means for averaging, for sending said averaged background noise estimates periodically during said silence period; and means for enabling the speech coder during said first extended voice detection period and said second extended voice detection period.

* * * * *